US009567186B2

(12) United States Patent
Kucera

(10) Patent No.: US 9,567,186 B2
(45) Date of Patent: Feb. 14, 2017

(54) MOTORIZED HOSE REEL WITH ANTI-ROTATION INTERLOCK

(71) Applicant: Coxwells, Inc., Tempe, AZ (US)

(72) Inventor: John G. Kucera, Mesa, AZ (US)

(73) Assignee: Coxwells, Inc., Tempe, AZ (US)

( * ) Notice: Subject to any disclaimer, the term of this patent is extended or adjusted under 35 U.S.C. 154(b) by 352 days.

(21) Appl. No.: 14/531,470

(22) Filed: Nov. 3, 2014

(65) Prior Publication Data

US 2015/0129703 A1 May 14, 2015

Related U.S. Application Data

(60) Provisional application No. 61/902,457, filed on Nov. 11, 2013.

(51) Int. Cl.
*B65H 75/30* (2006.01)
*B65H 75/44* (2006.01)

(52) U.S. Cl.
CPC ..... *B65H 75/4428* (2013.01); *B65H 75/4486* (2013.01)

(58) Field of Classification Search
CPC .. B65H 75/30; B65H 75/4428; B65H 75/4486
USPC ..... 242/390.8, 394, 395, 545
See application file for complete search history.

(56) References Cited

U.S. PATENT DOCUMENTS 3,937,415 A * 2/1976 Prinz ..... A01K 89/0165 242/297
4,012,002 A * 3/1977 McDonald ..... B65H 75/4486 192/71
4,393,803 A * 7/1983 Donalies ..... B63B 21/16 114/254
4,664,331 A * 5/1987 Halbrook ..... B65H 49/32 191/12.2 A
4,830,300 A * 5/1989 Taylor ..... B65H 54/58 242/390
5,800,105 A * 9/1998 Stump ..... B60P 7/083 242/394
5,836,536 A * 11/1998 Bodden ..... B65H 54/54 242/390.5

* cited by examiner

*Primary Examiner* — Sang Kim
(74) *Attorney, Agent, or Firm* — Hartman Tittus PLC; John D. Titus

(57) ABSTRACT

A motorized hose reel with a positive locking mechanism includes a spool that is rotatably supported by a support frame, a motor in driving communication with the spool and a locking pin. The locking pin is movable to any one of three positions. In the first position, a spring forces the locking pin to engage a corresponding aperture in the hose reel spool. As the locking pin is rotated, a shaft extending radially from the locking pin engages a track formed in the housing. This causes the locking pin to withdraw from the hose reel spool against the force of the spring. Further rotation of the locking pin causes the radially-extending shaft to engage a detent, which holds the locking pin away from the hose reel spool. Still further rotation of the locking pin causes the radially-extending shaft to close a switch, which completes an electrical circuit to the motor.

8 Claims, 4 Drawing Sheets

MOTORIZED HOSE REEL WITH ANTI-ROTATION INTERLOCK

BACKGROUND OF THE INVENTION

This invention relates generally to take-up reels of the type used for winding, and paying-out flexible elongated members such as hoses and electrical cables and, in particular, to motorized take-up reels.

It is well known in the art to provide an apparatus wherein an elongate flexible member such as a cable, rope, hose, electrical cord or the like is wound about a take-up reel for storage when not in use, and which is paid out by unwinding from the take-up reel to the appropriate length as required. A popular application for this arrangement is use of a flexible hose for carrying air, water, oil, grease, or the like from a reservoir to a dispensing nozzle. For example, in a typical mobile Liquefied Petroleum (LP) gas delivery truck, LP gas is delivered from a pressurized tank to a take-up reel which stores a length of tubular hose. When LP gas is to be delivered, the hose is pulled from the reel until the desired length is paid out. When the hose is no longer in use, a motor is engaged to rewind the hose back onto the reel.

It is often desirable to provide a positive lock to prevent the inadvertent unwinding of the hose from the reel. A common means for positively locking a non-motorized hose reel is a "pin-lock," which is a simple spring-loaded mechanism mounted to the reel frame. The spring-loaded mechanism pushes a small pin through one of a plurality of holes in one of the flanges of the reel to lock the reel to the frame. To release the reel, the pin is withdrawn from the flange and rotated to a position where a detent, catch, or similar mechanism holds the pin away from the flange. A conventional pin lock is not compatible, however, with a motorized hose reel because of the possibility of accidentally engaging the motor when the pin lock is still engaged. What is needed therefore is a pin lock that includes an interlock to prevent engagement of the motor unless the pin lock has already been disengaged.

SUMMARY OF THE INVENTION

The present invention comprises a motorized hose reel with a positive locking mechanism. According to an illustrative embodiment the hose reel includes a spool that is rotatably supported by a support frame, a motor in driving communication with the spool and a locking pin. The locking pin is movable to any one of three positions. In the first position, a spring forces the locking pin to engage a corresponding aperture in the hose reel spool, which positively locks the spool against rotation. As the locking pin is rotated, a shaft extending radially from the locking pin engages a track formed in the locking pin housing. This causes the locking pin to withdraw from the hose reel spool against the force of the spring. Further rotation of the locking pin causes the radially-extending shaft to engage a detent formed in the track, which holds the locking pin away from the hose reel spool. Still further rotation of the locking pin causes the radially-extending shaft to close an electrical switch, which completes a circuit to the drive motor. Since the mechanism that closes the electrical switch to the drive motor is an integral part of the locking pin, it is impossible for a user to accidentally engage the motor without first disengaging the locking pin. Although the illustrative embodiment is described in terms of a hose reel, the term "hose reel" is not intended to limit the invention to storage devices for hoses but is applicable to storage devices for any elongate member including cables, rope, wire, or the like.

BRIEF DESCRIPTION OF THE DRAWING

The present invention will be better understood from a reading of the following question detailed description, taken in conjunction with the accompanying drawing figures in which like references designate like elements and, in which.

DETAILED DESCRIPTION

Figure 1:
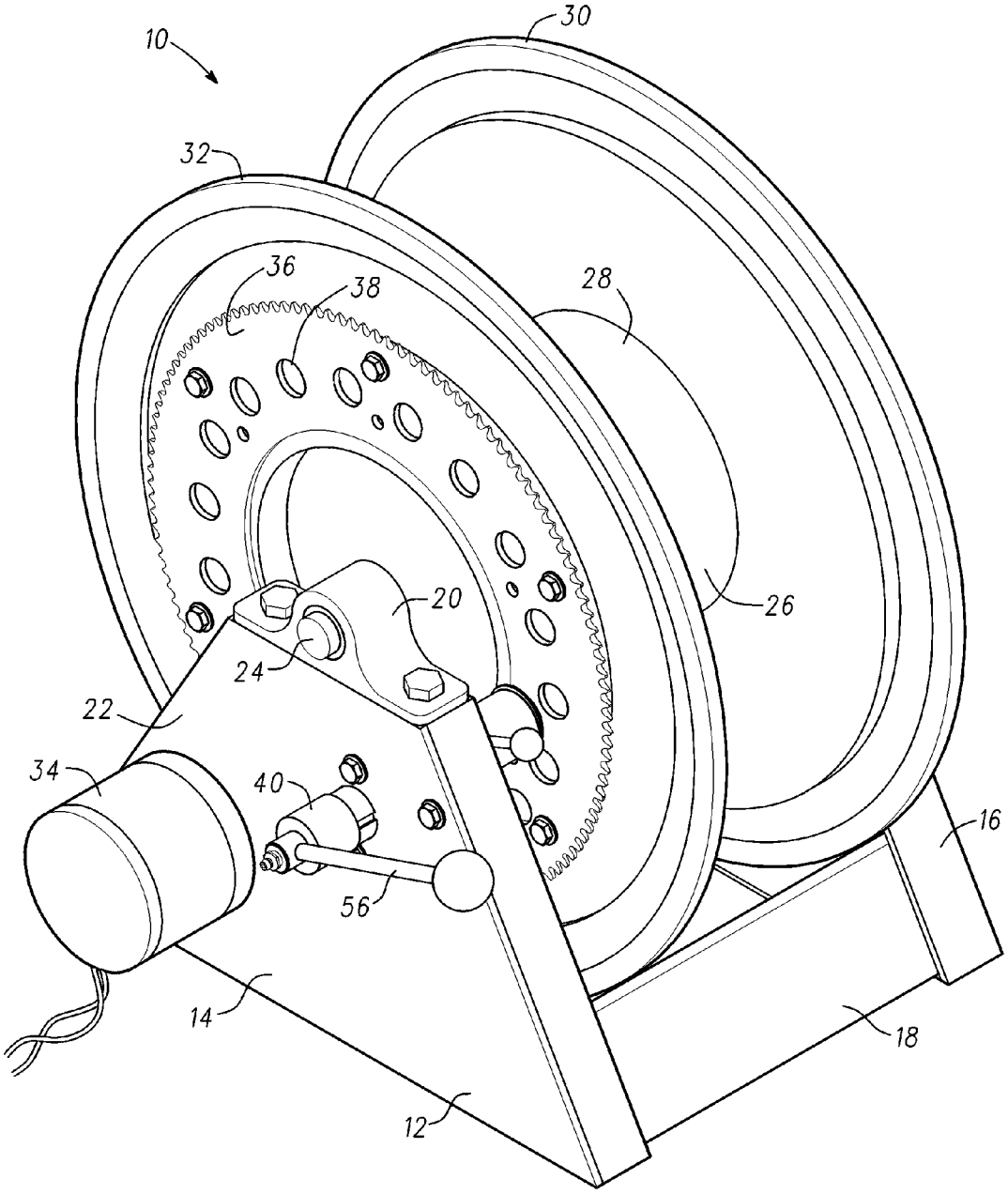
FIG. 1 is a front perspective view of a hose reel incorporating features of the present invention.
Figure 2:
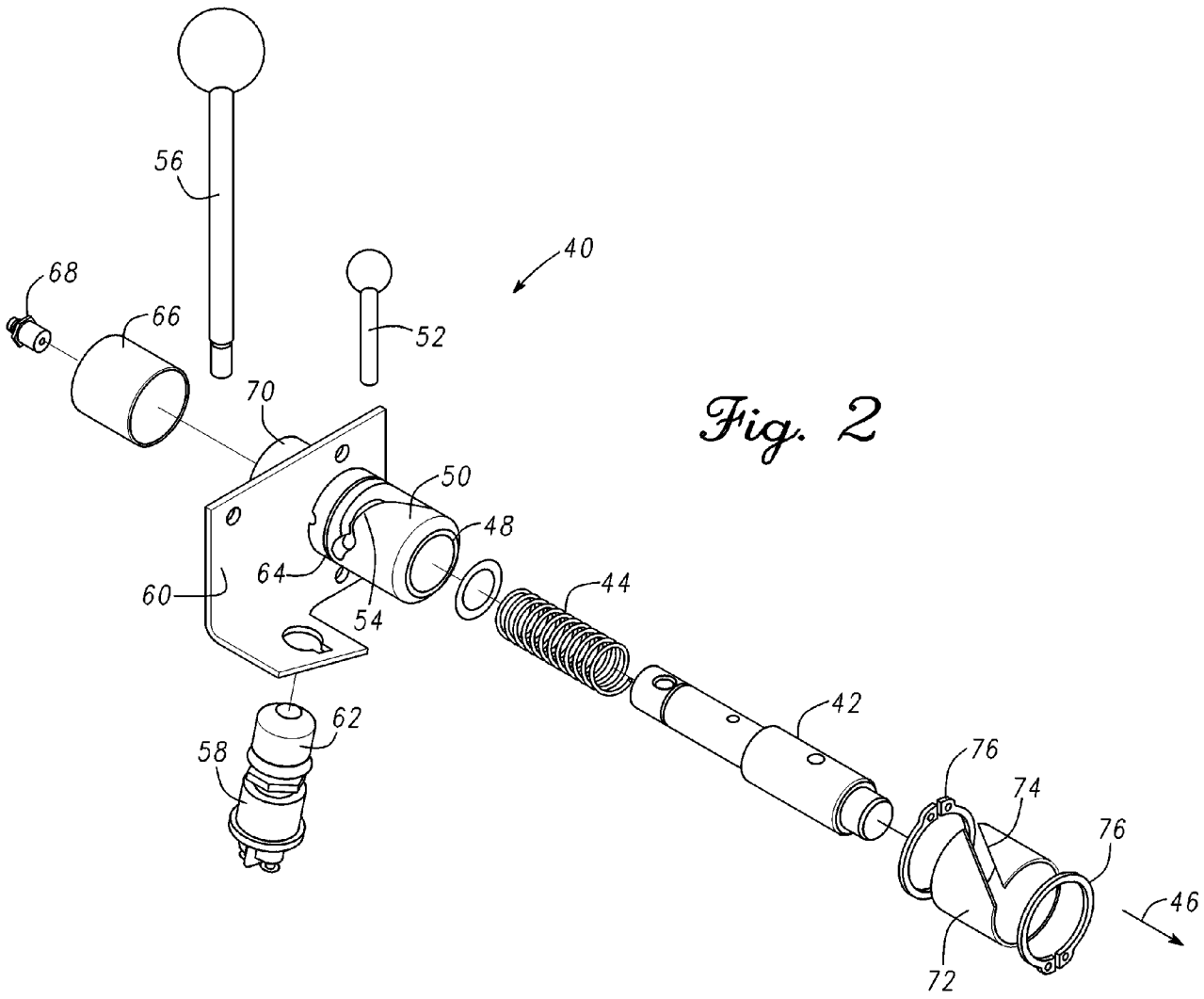
FIG. 2 is an exploded perspective view of the pin-lock mechanism of the hose reel of FIG. 1.

The drawing figures are intended to illustrate the general manner of construction and are not necessarily to scale. In the detailed description and in the drawing figures, specific illustrative examples are shown and herein described in detail. It should be understood, however, that the drawing figures and detailed description are not intended to limit the invention to the particular form disclosed, but are merely illustrative and intended to teach one of ordinary skill how to make and/or use the invention claimed herein and for setting forth the best mode for carrying out the invention.

With reference to FIG. 1, a reel assembly 10 having an anti-rotation interlock mechanism incorporating features of the present invention comprises a frame 12 composed of a right side plate 14, a left side plate 16, and a center support section 18. A right side pillow block housing 20 is attached to the upper end 22 of right side plate 14. A left side pillow block housing (not shown) is similarly attached to the upper end of left side plate 16. Together the right side pillow block housing 20 and the left side pillow block housing support a shaft 24. A drum 26 is supported for rotation relative to frame 12 by shaft 24. Drum 26 comprises a cylindrical section 28 and a pair of radially extending flanges 30, 32 which cooperate to form a containment apparatus which is suitable for winding up an elongated member such as a hose or electrical cable. Reel assembly 10 is provided with a motor 34 which engages a sprocket 36 attached to flange 32 of drum 26. When activated, motor 34 drives drum 26 in a predetermined rotational direction, for example, to wind up and store a length of hose previously paid out from the reel assembly 10.

With additional reference to FIGS. 2-5, reel assembly 10 further includes a locking pin assembly 40 comprising a locking pin 42 which is spring-loaded by an engagement spring 44 in a direction 46 away from the open end 48 of pin housing 50. Locking pin assembly 40 mounted on right side plate 14 of frame 12 so that locking pin 42 is in registry with a radial array of apertures such as aperture 38 formed in sprocket 36. An actuator shaft 52 is attached to and extends radially outward from locking pin 42 through a track 54 formed in pin housing 50. An operator handle 56 is also attached to and extends radially outward from locking pin 42 approximately parallel to actuator shaft 52. A momentary contact switch 58 is attached to mounting bracket 60 so that the actuator end 62 is approximately in registry with the upper end 64 of track 50. A dust cover 66 and grease fitting 68 may optionally be fitted to closed end 70 of pin housing 50. A dust shield 72 having a helical opening 74 may optionally be fitted to open and 48 of pin housing 50 and may be retained by conventional means such as snap rings 76.

Figure 6:
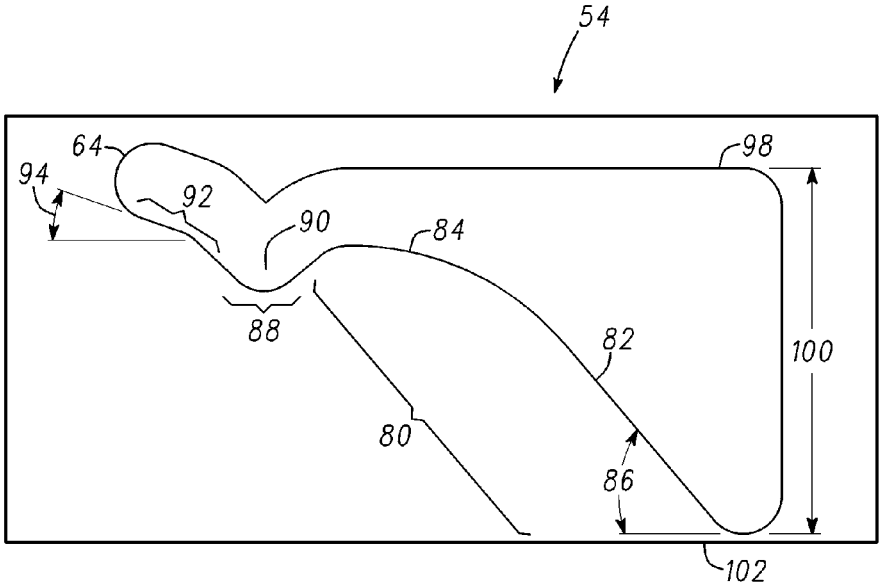
FIG. 6 is a detailed view of the track formed in the pin lock mechanism housing of FIG. 2.

FIG. 6 is a representation of track 54 of pin housing 50 rolled out flat from its normal cylindrical form for clarity. With additional reference to FIG. 6, track 54 comprises a first section 80 which has both a helical portion 82 and a curvilinear portion 84. The helical portion 82 has a helical pitch 86 of approximately 45° while the curvilinear portion 84 has a helical pitch that gradually decreases from 45° to approximately 12°. The second section 88 of track 54 has a negative helical pitch followed by a positive helical pitch with a local minimum region disposed therebetween to form a detent region 90. The third section 92 has a positive helical pitch 94 of approximately 30°. For reasons that will be more fully explained hereinafter, the back wall 98 has a helical pitch of 0° and is displaced by a distance 100 from the lower end 102 of track 54 in the region of first section 80, but is essentially parallel to second section 88 and third section 92 of track 54.

Figure 3:
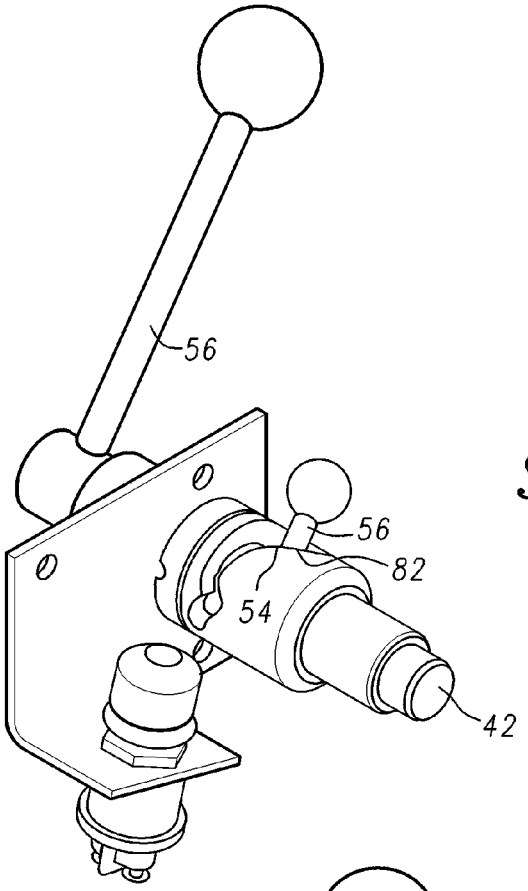
FIG. 3 is a perspective view of the pin lock mechanism of FIG. 2 in the first position.
Figure 4:
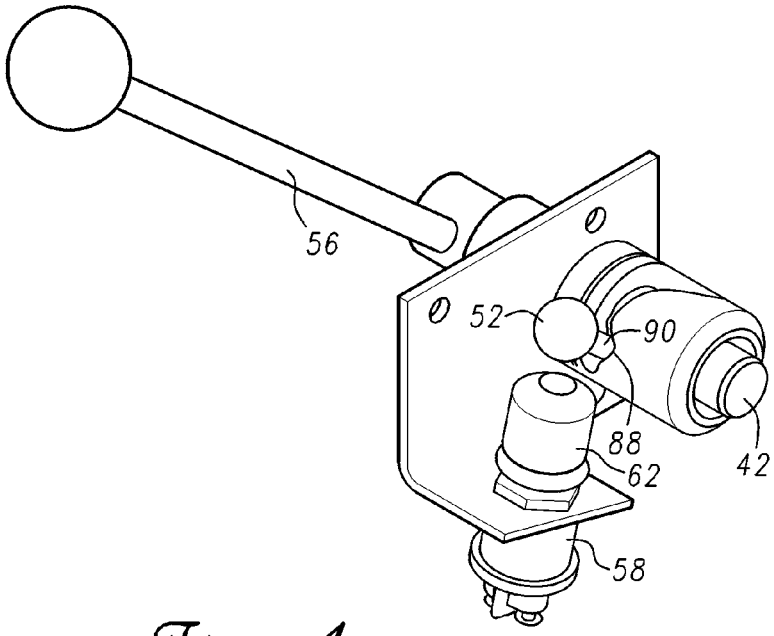
FIG. 4 is a perspective view of the pin lock mechanism of FIG. 2 in the second position.
Figure 5:
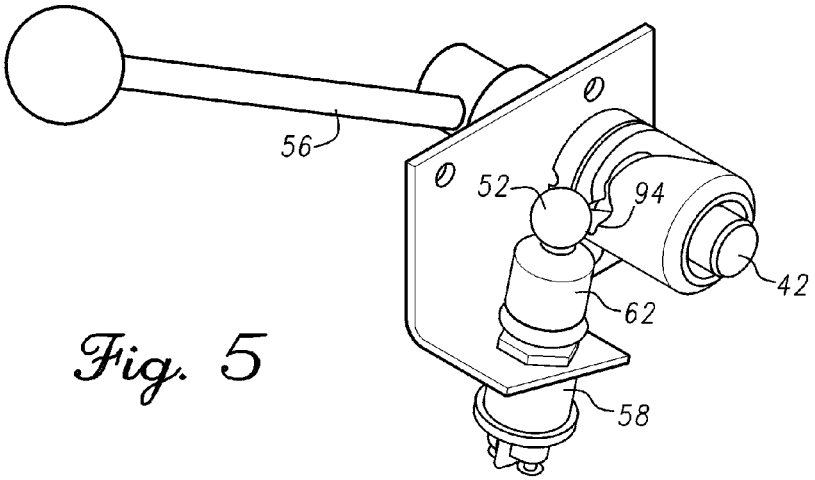
FIG. 5 is a perspective view of the pin lock mechanism of FIG. 2 in the third position.

FIGS. 3-5 shown locking pin assembly 40 assembled with the dust shield 72 removed for clarity. With particular reference to FIGS. 3-5, in the first or "locked" position as shown in FIG. 3, engagement spring 44 forces locking pin 42 out of pin housing 50 until actuator shaft 52 is proximal the lower end 102 of track 54. Simultaneously, locking pin 42 engages one of the apertures 38 to lock the drum 26 of reel assembly 10 against rotation. In order to free the drum 26 to allow the hose to be uncoiled from drum 26, locking pin is withdrawn in a direction opposite to direction 46. This may be accomplished in one of two methods. In the first method, the operator pulls operator handle 56 rearwards until actuator shaft 52 reaches back wall 98 then the operator rotates operator handle 56 (counterclockwise as seen in FIG. 3) until actuator shaft 52 drops into detent region 90 as shown in FIG. 4 which is the second or "free" position. In the second method, the operator rotates operator handle 56 counterclockwise so that actuator shaft 52 engages the first section 80 of track 54. First section 80, which acts as a ramp to withdraw locking pin 42 until actuator shaft 52 drops into detent region 90. In the illustrative embodiment, the angular displacement of locking pin 42 between the locked position and the free position is approximately 120°.

As the operator rotates operator handle 56 further clockwise, actuator shaft 52 presses against the actuator portion 62 of momentary contact switch 58 as shown in FIG. 5 which is the third or "activate" position. The momentary contact switch 58 completes a circuit to motor 34, which in turn engages to rotate drum 26 for rewinding the hose or other elongate member onto drum 26. Although in the illustrative embodiment, actuator shaft 52 presses directly against a momentary contact electrical switch, the invention is not limited to use of a momentary contact electrical switch. Other switches, including pneumatic, hydraulic, and other linkages that require locking pin 42 to be disengaged before the switch can be activated are considered within the scope of the present invention. Because third section 92 is also inclined, engagement spring 44 continues to urge locking pin 42 back toward the second or "free" position. Thus the operator must maintain pressure on operator handle 56 for motor 34 to continue to operate. This feature provides additional safety to prevent unintended operation of motor 34. In the illustrated embodiment, the angular displacement of locking pin 42 between the free position and the engaged position is approximately 30°.

Once all of the hose or other elongate member has been wound onto drum 26, the operator may move locking pin 42 from the "free" to the "locked" position again in one of two methods. In the first method, the operator pulls operator handle 56 rearwards until actuator shaft 52 reaches back wall 98 then the operator rotates operator handle 56 fully clockwise until actuator shaft 52 is clear of first section 80, then releases the operator handle 56 to allow engagement spring 44 to move locking pin 42 into the "locked" position. In the second method, the operator rotates operator handle 56 clockwise until actuator shaft 52 is free of detent portion 90 of track 54, then releases operator handle 56. Engagement spring 44 is then able to move locking pin 42 into the "locked" position while first section 80 acts as a ramp to rotate locking pin 42 as it moves into the "locked" position.

Although certain illustrative embodiments and methods have been disclosed herein, it will be apparent from the foregoing disclosure to those skilled in the art that variations and modifications of such embodiments and methods may be made without departing from the invention. For example in the illustrated embodiment track 54 formed in pin housing 50 has a left-hand helical twist so that operator handle 56 is moved counterclockwise to withdraw the locking pin 42, pin housing 50 may be provided with a right-hand helical twist. Accordingly, it is intended that the invention should be limited only to the extent required by the appended claims and the rules and principles of applicable law. Additionally, as used herein, references to direction such as "up" or "down" are intend to be exemplary and are not considered as limiting the invention and, unless otherwise specifically defined, the terms "generally," "substantially," or "approximately" when used with mathematical concepts or measurements mean within ±10 degrees of angle or within 10 percent of the measurement, whichever is greater, and as used herein, a step of "providing" a structural element recited in a method claim means and includes obtaining, fabricating, purchasing, acquiring or otherwise gaining access to the structural element for performing the steps of the method.

What is claimed is:

1. A reel for storing a flexible elongate member, said reel comprising:

a support frame;

a spool rotatably supported by said support frame, said spool having a substantially cylindrical body and a pair of flanges extending radially outward from opposite ends of said body;

a motor in driving communication with said spool for rotating said spool in a first rotational direction;

a locking pin operatively disposed between said support frame and said spool, said locking pin moveable among a first position, a second position and a third position, the first position comprising said locking pin engaging a corresponding aperture in said spool whereby said spool is locked against rotation, said second position comprising said locking pin disengaging the corresponding aperture in said spool, whereby said spool is capable of substantially free rotation and said third position comprising said locking pin activating a switch that engages said motor, whereby said motor operates to drive said spool in the first rotational direction.

2. The reel of claim 1, wherein:

said locking pin comprises a pin body and a spring urging said pin body toward the first position.

3. The reel of claim 2, wherein:

said locking pin further comprises a cylindrical housing having a curvilinear track formed therein and wherein said pin body further comprises a radially extending shaft that extends through the curvilinear track.

4. The reel of claim 3, wherein:

the curvilinear track includes a first helical portion, whereby rotation of said locking pin with said radially extending shaft engaging the first helical portion causes said pin body to move axially from the first position to the second position.

5. The reel of claim 4, wherein:

the curvilinear track includes a detent portion, whereby rotation of said locking pin until said radially extending shaft engages the detent portion causes the detent portion to retain said locking pin in the second position against a force applied by the spring.

6. The reel of claim 5, wherein:

the curvilinear track includes a second helical portion separated from the first helical portion by the detent portion, whereby rotation of said locking pin with said radially extending shaft engaging the second helical portion causes said pin body to move from the second position toward the third position and causes said spring to urge said locking pin toward said second position, whereby the locking pin must be held in said third position by an external force.

7. The reel of claim 6, wherein:

the radially extending shaft includes a portion that activates the switch that engages said motor.

8. The reel of claim 7, further comprising:

a cylindrical dust sleeve surrounding the housing, said dust sleeve having a helical slot formed therein of opposite twist to the first helical portion.

* * * * *